US010723369B2

(12) United States Patent
Timan

(10) Patent No.: US 10,723,369 B2
(45) Date of Patent: Jul. 28, 2020

(54) BOGIE WITH A MOTOR MOUNT FOR A LINEAR INDUCTION MOTOR

(71) Applicant: Bombardier Transportation GmbH, Berlin (DE)

(72) Inventor: Peter Timan, Ontario (CA)

(73) Assignee: Bombardier Transportation GmbH, Berlin (DE)

( * ) Notice: Subject to any disclaimer, the term of this patent is extended or adjusted under 35 U.S.C. 154(b) by 384 days.

(21) Appl. No.: 15/652,380

(22) Filed: Jul. 18, 2017

(65) Prior Publication Data

US 2018/0022363 A1 Jan. 25, 2018

(30) Foreign Application Priority Data

Jul. 19, 2016 (CA) ..... 2936722

(51) Int. Cl.

| | |
|---|---|
| ***B61C 17/00*** | (2006.01) |
| ***B61F 5/50*** | (2006.01) |
| ***B61F 3/04*** | (2006.01) |
| ***B61C 13/00*** | (2006.01) |
| ***B61F 1/06*** | (2006.01) |
| ***B61F 1/12*** | (2006.01) |
| ***B61F 3/02*** | (2006.01) |

(52) U.S. Cl.

CPC ..... *B61C 17/00* (2013.01); *B61C 13/00* (2013.01); *B61F 1/06* (2013.01); *B61F 1/12* (2013.01); *B61F 3/02* (2013.01); *B61F 3/04* (2013.01); *B61F 5/50* (2013.01)

(58) Field of Classification Search

CPC ..... B60L 13/035; B61B 13/12; B61C 17/00; B61C 13/00; B61F 5/50; B61F 1/06; B61F 1/12; B61F 3/02; B61F 3/04

See application file for complete search history.

(56) References Cited

U.S. PATENT DOCUMENTS 2,888,880 A * 6/1959 Zach ..... B61C 9/00 105/132.1
3,168,270 A 2/1965 Bligard et al.
3,242,877 A 3/1966 Hirst et al.
(Continued)

FOREIGN PATENT DOCUMENTS

CN 204415415 U * 6/2015
CN 204415415 U 6/2015
(Continued)

*Primary Examiner* — Scott A Browne
(74) *Attorney, Agent, or Firm* — The Webb Law Firm

(57) ABSTRACT

A bogie assembly for a rail vehicle comprises a bogie frame, two wheel axles supporting the bogie frame, a primary of a linear induction motor and two motor mounts. The two motor mounts are located proximate a different extremity of the primary and support the linear induction motor underneath the bogie frame. Each one of the two motor mounts has a bogie interface, a motor interface, a first spring, a conical spring, a core pin and a nut. The first spring is connected to the bogie interface on the bogie side while the conical spring is connected to the same bogie interface on the motor side. The core pin extends sequentially from the motor interface through the conical spring, then through the bogie interface and finally through the first spring where it is held in place by the nut on the other side of the first spring.

9 Claims, 3 Drawing Sheets

(56) References Cited

U.S. PATENT DOCUMENTS

| | | | | |
|---|---|---|---|---|
| 3,386,752 | A * | 6/1968 | Tea | B60G 11/182 280/124.165 |
| 3,989,126 | A | 11/1976 | Katzer | |
| 4,391,436 | A * | 7/1983 | Fishbaugh | F16F 3/093 267/140.2 |
| 5,116,030 | A | 5/1992 | Nowak et al. | |
| 5,121,905 | A | 6/1992 | Mann et al. | |
| 5,228,663 | A | 7/1993 | Adler et al. | |
| 6,267,062 | B1 * | 7/2001 | Hamilton, Jr. | B61C 7/04 105/26.05 |
| 6,450,474 | B1 | 9/2002 | Bucksbee | |
| 7,044,457 | B2 | 5/2006 | Bucksbee | |
| 7,836,830 | B2 * | 11/2010 | Searancke | B60L 13/035 104/290 |
| 2008/0136135 | A1 | 6/2008 | Maciak | |

FOREIGN PATENT DOCUMENTS

| | | | |
|---|---|---|---|
| EP | 0005730 | A1 | 12/1979 |
| EP | 1643154 | B1 | 3/2007 |
| GB | 794254 | A | 4/1958 |

* cited by examiner

BOGIE WITH A MOTOR MOUNT FOR A LINEAR INDUCTION MOTOR

CROSS-REFERENCE TO RELATED APPLICATION

This application claims priority to Canadian Patent Application No. 2,936,722 filed Jul. 19, 2016, the disclosure of which is hereby incorporated in its entirety by reference.

FIELD OF THE INVENTION

The present invention generally relates to the field of propulsion for guided mass transit vehicles. More specifically, the invention relates to a bogie of a rail vehicle having an adjustable mounting system for mounting a linear induction motor underneath it.

BACKGROUND OF THE INVENTION

Linear induction motors (LIM) have been used in the field of mass transportation for decades. Yet, because of the long life span of rail vehicles, there hasn't been that many development cycles permitting to substantially evolve the LIM technology. Consequently, there are still many aspects of the technology left to be desired.

One such example has to do with height adjustment. LIM performance requires close control of the distance between its primary and its reaction rail (or secondary). With the present mounting arrangement of the LIM underneath a rail vehicle bogie, the height adjustment takes many hours. This wouldn't be too bad if such adjustment was made once and for all, but because wheel wear, this distance needs to be regularly readjusted. This cyclic maintenance is exacerbated by the fact that components are sometimes seized, resulting in further time consuming efforts to free the seized components, with consequent possible damage or expensive component replacement.

Another area needing improvement has to do with the complexity of existing LIM mounting systems, which are complex and expensive. Whether these systems use cams, multiple linkages arrangements or cumbersome shimming designs, they could all benefit from having their cost decreased.

There is therefore a clear need for an improved LIM mounting system for a bogie.

SUMMARY OF THE INVENTION

It is an object of the present invention to provide a bogie assembly for a rail vehicle using linear induction motor technology that overcomes or mitigates one or more disadvantages of known bogie assemblies, or at least provides a useful alternative.

In accordance with an embodiment of the present invention, there is provided a bogie assembly for a rail vehicle. The bogie assembly comprises a bogie frame, two wheel axles supporting the bogie frame, a primary of a linear induction motor and two motor mounts. The two motor mounts are located proximate a different extremity of the primary and support the linear induction motor underneath the bogie frame. Each one of the two motor mounts has a bogie interface, a motor interface, a first spring, a conical spring, a core pin and a nut. The bogie interface, which has a bogie side and an opposed motor side, is connected to the bogie frame while the motor interface is connected to the primary. The first spring is connected to the bogie interface on the bogie side while the conical spring is connected to the same bogie interface but on the motor side. The core pin is also connected to the motor interface. The core pin extends sequentially from the motor interface through the conical spring, then through the bogie interface and finally through the first spring where it is held in place by the nut on the other side of the first spring. The conical spring is connected to the core pin. Because it is threaded on the core pin, tightening the nut on the core pin compresses both the first spring and the conical spring in opposite directions on different sides of the bogie interface.

Optionally, the bogie frame may be made of two half-bogie frames pivotably connected to each other so that the two wheel axles may be non-parallel. Each one of the two motor mounts is connected underneath a different one of the two half-bogie frames. Being resilient, the first springs and the conical springs of the two motor mounts can accommodate a change in distance between the two motor supports caused by one half-bogie pivoting with respect to the other. This situation happens in curves, when the two wheel axles are no longer parallel to each other.

Preferably, the conical spring is removably attached to the bogie interface.

More preferably, both the conical spring and the first spring use an elastomer. The conical spring further comprises a metallic component bonded to the elastomer.

To help with height adjustment, the bogie assembly may further comprise a shim placed between the conical spring and the bogie interface. This allows adjusting the height between the motor interface and the bogie interface.

BRIEF DESCRIPTION OF DRAWINGS

These and other features of the present invention will become more apparent from the following description in which reference is made to the appended drawings wherein.

DETAILED DESCRIPTION OF THE INVENTION

The present invention relates to a bogie assembly for a rail vehicle adapted to propulsion by a linear induction motor having an improved motor mount assembly.

Figure 1:
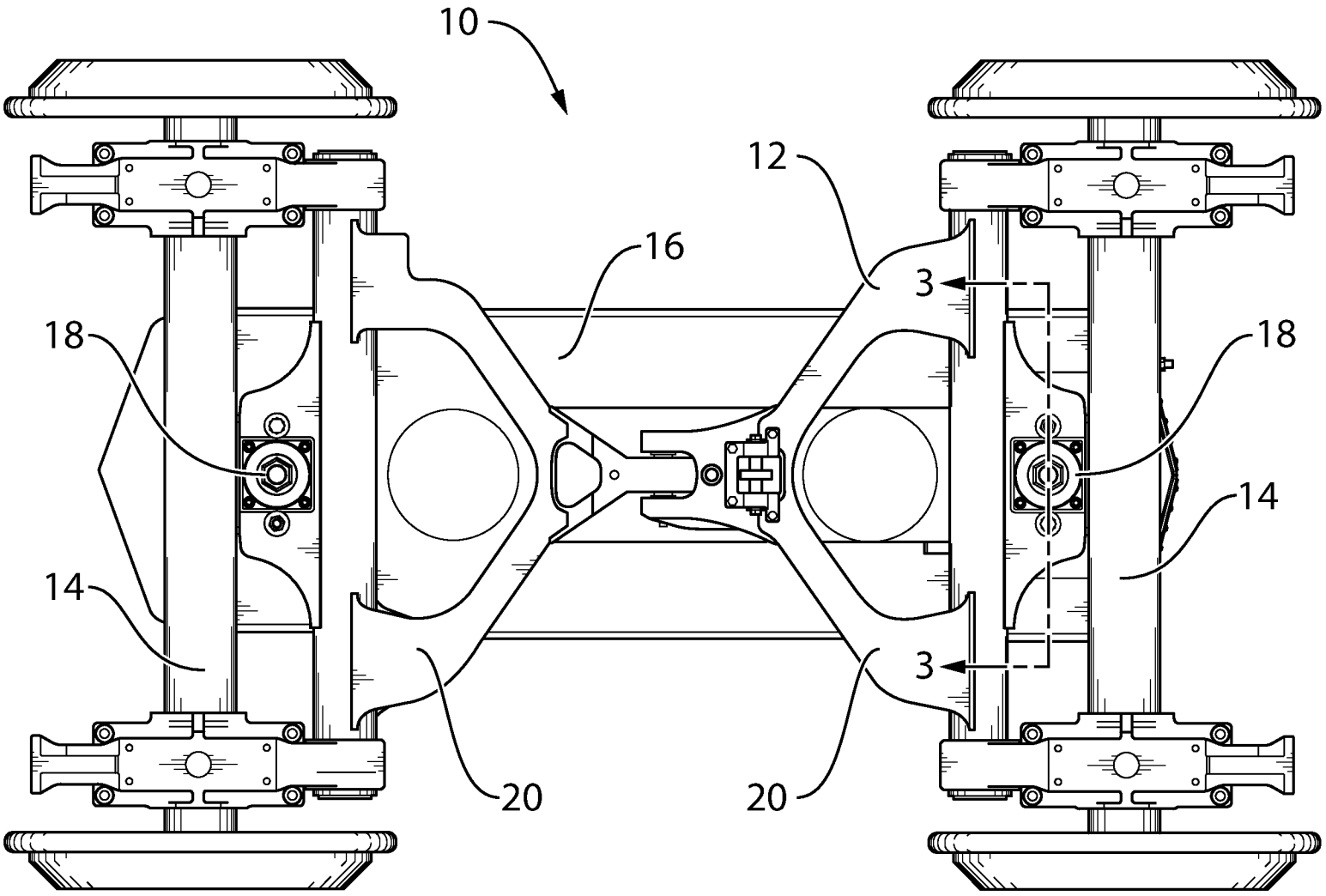
FIG. 1 is a top view of a bogie assembly in accordance with an embodiment of the present invention.

FIG. 1 is now referred to. The bogie assembly 10 for a rail vehicle comprises a bogie frame 12, two wheel axles 14 supporting the bogie frame 12, a primary 16 of a linear induction motor and two motor mounts 18.

The bogie frame 12 may be of a rigid, conventional type, or may be or the articulated type, as depicted in FIG. 1. The articulated type of bogie is better adapted to rail tracks having very tight curves. It is also very well adapted to LIM propulsion as it is possible to keep the primary 16 better aligned with a reaction rail fixed on a guideway. The bogie frame 12 of the articulated bogie 10 is made of two half-bogie frames 20 pivotably connected to each other, allowing the two wheel axles 14 to be non-parallel. Each one of the two motor mounts 18 is connected underneath a different one of the two half-bogie frames 20.

Figure 2:
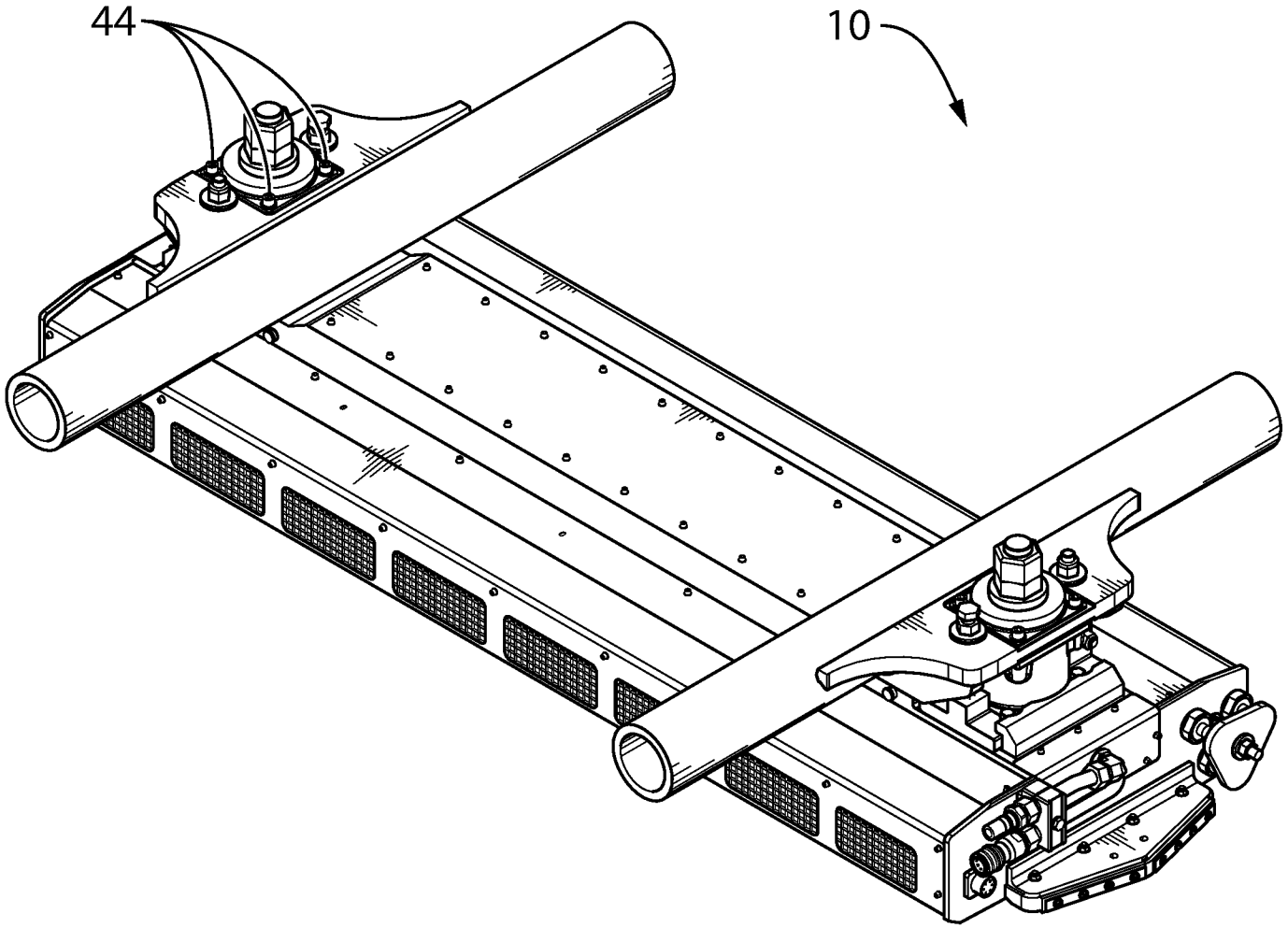
FIG. 2 is an isometric view of a sub-assembly of the bogie assembly of FIG. 1 showing a primary of a linear induction motor and its motor mounts.
Figure 3:
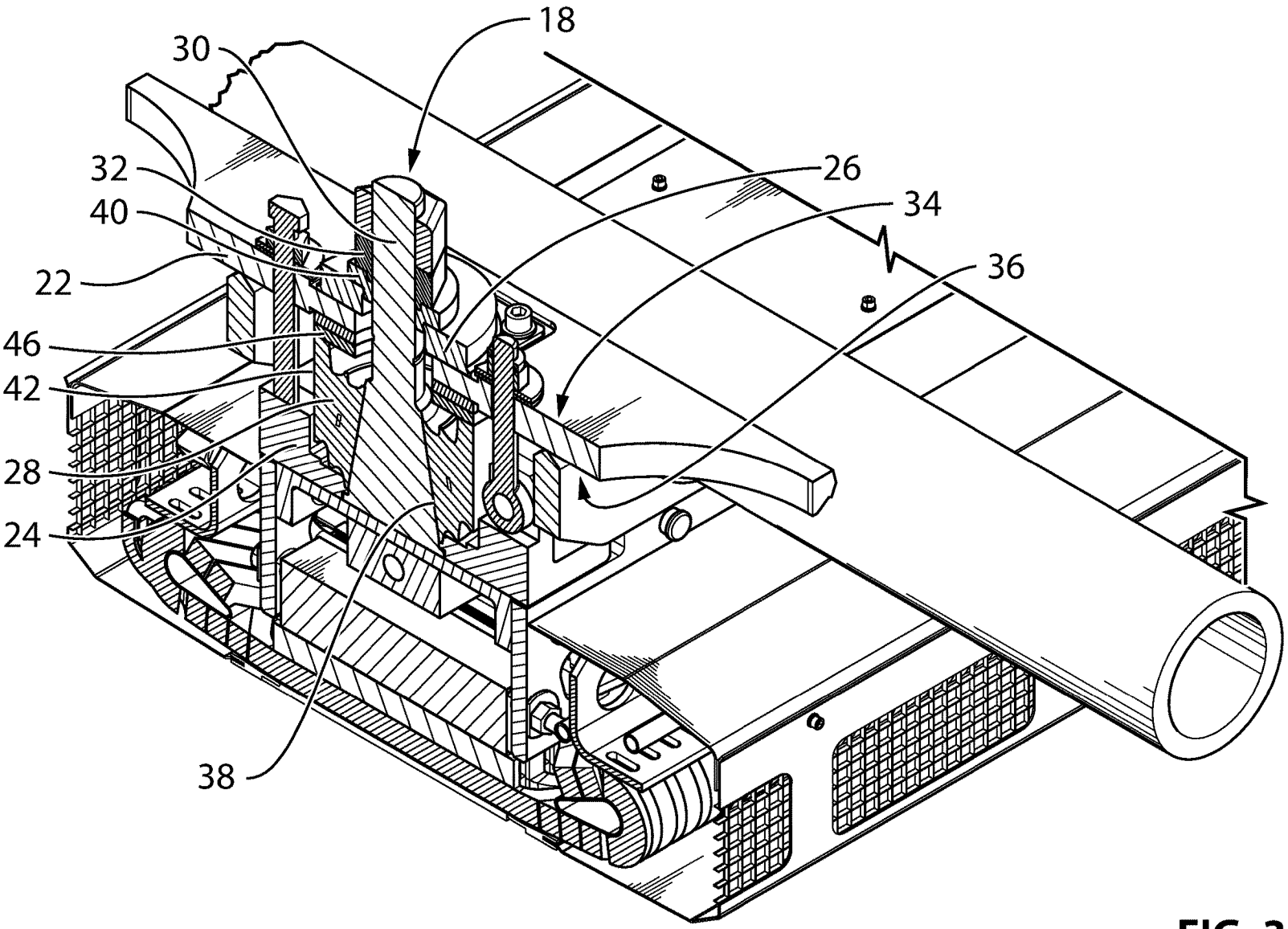
FIG. 3 is an isometric cross-sectional side view of one of the motor mounts of the bogie assembly of FIG. 1.

FIGS. 2 and 3 are now concurrently referred to. The two identical motor mounts 18 are located proximate a different extremity of the primary 16 to support the primary 16 underneath the bogie frame 12. Each one of the two motor mounts 18 have a bogie interface 22, a motor interface 24, a first spring 26, a conical spring 28, a core pin 30 and a nut 32. The bogie interface 22, which has a bogie side 34 and an opposed motor side 36, allows a connection to the bogie frame 12 while the motor interface 24 allows the connection to the primary 16. Both the bogie interface 22 and the motor interface 24 are preferably of a removable type, allowing easy installation and removal of the motor mount 18 in case of damage.

The first spring 26 is connected to the bogie interface 22 on the bogie side 34 while the conical spring 28 is connected to the same bogie interface 22 but on the motor side 36. The core pin 30, solidly connected to the motor interface 24, extends sequentially from the motor interface 24 through the conical spring 28, then through the bogie interface 22 and finally through the first spring 26 where it is held in place by the nut 32 on the other side of the first spring 26. Because it is threaded on the core pin 30, tightening the nut 32 against a collar 40 on the core pin 30 compresses both the first spring 26 and the conical spring 28 against each other on different sides of the bogie interface 22.

The conical spring 28 is centered on the core pin 30 through its central mounting interface 38. At its external mounting interface 42, the conical spring 28 is mounted to the bogie interface 22. As shown in FIG. 2, four bolts 44 are used to secure the conical spring 28 in this arrangement.

Both the first spring 26 and the conical spring 28 may use an elastomer as its resilient element. The first spring 26 is typically a flat spring, or a sheet of elastomer bonded between two steel plates. The conical spring 28 may comprise concentric steel cylinder or truncated cones bonded by layers of elastomer. Companies such as Trelleborg® manufacture these kinds of springs.

Being resilient, the first springs 26 and the conical springs 28 of the two motor mounts 18 can accommodate a change in distance between them caused by one half-bogie 20 pivoting with respect to the other half-bogie 20. This situation happens in curves, when the two wheel axles 14 are no longer parallel to each other.

To help with height adjustment, a shim 46 may be placed between the conical spring 28 and the bogie interface 22. This allows a coarse adjustment of the distance between the motor interface 24 and the bogie interface 22. This distance, called the LIM gap, is important as it determines the distance between the bottom of the primary 16 and the top of the reaction rail (not shown), directly impacting the LIM performance. Thanks to its design, the conical spring 28 has a relatively low vertical stiffness, allowing high vertical shear deflection without causing excessive forces, while having a relatively high radial stiffness, allowing transmission of high traction forces. This relatively low vertical stiffness permits a fine adjustment of the LIM gap by turning the nut 32 on the core pin 30, preloading both the first spring 26 and the conical spring 28 and bringing the motor interface 24 closer to the bogie interface 22. By comparison, the first spring 26 is relatively stiffer in the vertical direction than the conical spring 28. Hence, most of the LIM gap adjustment is provided by the conical spring 28. Preloading the springs 26, 28 limits the deviation in the LIM gap while still improving shock and vibration attenuation. This results in improved durability of the primary 16 and of its two motor mounts 18.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

What is claimed is:

1. A bogie assembly for a rail vehicle, said bogie assembly comprising:

a bogie frame;

two wheel axles, said two wheel axles supporting said bogie frame;

a primary of a linear induction motor;

two motor mounts, said two motor mounts being located proximate a different extremity of said linear induction motor and supporting said primary underneath said bogie frame, each one of said two motor mounts having:

a bogie interface, said bogie interface being connected to the bogie frame, said bogie interface having a bogie side and an opposed motor side;

a motor interface, said motor interface being connected to the primary;

a first spring, said first spring being connected to said bogie interface on said bogie side;

a conical spring, said conical spring being connected to said bogie interface on said motor side;

a shim placed between said conical spring and said bogie interface so as to adjust a height between said motor interface and said bogie interface;

a core pin, said core pin being connected to said motor interface, said core pin extending sequentially from said motor interface through said conical spring, through said bogie interface and through said first spring, said conical spring being connected to said core pin; and a nut, said nut being in contact with said first spring, said nut being threaded on said core pin, wherein tightening said nut on said core pin compresses both said first spring and said conical spring in opposite directions on different sides of said bogie interface wherein the conical spring is received within a recess of the motor interface.

2. The bogie assembly of claim 1 wherein said bogie frame is made of two half-bogie frames, said two half bogie frames being pivotably connected to each other so that said two wheel axles may be non-parallel, each one of said two motor mounts being connected underneath a different one of said two half-bogie frames, said first springs and said conical springs of said two motor mounts being resilient to accommodate a change in distance between said two motor supports whether said two wheel axles are parallel or whether said two wheel axles are non-parallel.

3. The bogie assembly of claim 1 wherein said conical spring and said first spring comprise an elastomer.

4. The bogie assembly of claim 3 wherein said conical spring further comprises a metallic component bonded to said elastomer.

5. The bogie assembly of claim 1 wherein said conical spring is removably attached to said bogie interface.

6. A motor mount for supporting a linear induction motor underneath a bogie of a rail vehicle, the motor mount comprising:

a bogie interface, said bogie interface being operative to being connected to the bogie of the rail vehicle, said bogie interface having a bogie side and an opposed motor side;

a motor interface, said motor interface being operative to being connected to the linear induction motor;

a first spring, said first spring being connected to a flat portion of said bogie interface on said bogie side;

a conical spring, said conical spring being connected to said flat portion of said bogie interface on said motor side;

a shim placed between said conical spring and said bogie interface so as to adjust a height between said motor interface and said bogie interface;

a core pin, said core pin being connected to said motor interface, said core pin extending sequentially from said motor interface through said conical spring, through said bogie interface and through said first spring, said conical spring being connected to said core pin; and a nut, said nut being in contact with said first spring, said nut being threaded on said core pin, wherein tightening said nut on said core pin compresses both said first spring and said conical spring in opposite directions on different sides of said bogie interface wherein the conical spring is received within a recess of the motor interface.

7. The motor mount of claim 6 wherein said conical spring and said first spring comprise an elastomer.

8. The motor mount of claim 7 wherein said conical spring further comprises a metallic component bonded to said elastomer.

9. The motor mount of claim 8 wherein said conical spring is removably attached to said bogie interface.

* * * * *